US011660494B2

(12) United States Patent
Cheng

(10) Patent No.: US 11,660,494 B2
(45) Date of Patent: May 30, 2023

(54) PUSH-UP EXERCISE DEVICE WITH HEIGHT ADJUSTMENT

(71) Applicant: SHANQ DIH CO., LTD., Tainan (TW)

(72) Inventor: Cheng-Kuo Cheng, Tainan (TW)

(73) Assignee: Shanq Dih Co., Ltd., Tainan (TW)

( * ) Notice: Subject to any disclaimer, the term of this patent is extended or adjusted under 35 U.S.C. 154(b) by 125 days.

(21) Appl. No.: 17/212,167

(22) Filed: Mar. 25, 2021

(65) Prior Publication Data

US 2022/0305326 A1 Sep. 29, 2022

(51) Int. Cl.
*A63B 21/00* (2006.01)
*A63B 23/12* (2006.01)

(52) U.S. Cl.
CPC ..... *A63B 21/4035* (2015.10); *A63B 23/1236* (2013.01); *A63B 2225/093* (2013.01)

(58) Field of Classification Search
CPC ..... A63B 21/00047; A63B 21/0005; A63B 21/00054; A63B 21/068; A63B 21/4027; A63B 21/4033; A63B 21/4035; A63B 23/12; A63B 23/1209; A63B 23/1236; A63B 2208/0295; A63B 2225/09; A63B 2225/093
See application file for complete search history.

(56) References Cited

U.S. PATENT DOCUMENTS

| | | | | |
|---|---|---|---|---|
| 5,226,868 | A * | 7/1993 | Montgomery | A63B 21/4035 482/141 |
| 7,503,884 | B1 * | 3/2009 | Schall | A63B 23/1209 482/141 |
| 9,717,948 | B1 * | 8/2017 | Hsu | A63B 23/1227 |
| 10,456,615 | B1 * | 10/2019 | Anthony | A63B 21/4029 |
| 2009/0170676 | A1 * | 7/2009 | Varga | A63B 21/4017 482/141 |
| 2009/0247378 | A1 * | 10/2009 | Carlesimo | A63B 26/00 482/141 |
| 2012/0040811 | A1 * | 2/2012 | DeTore | A63B 23/1236 482/141 |
| 2013/0072365 | A1 * | 3/2013 | Ross | A63B 23/1218 482/141 |
| 2022/0040523 | A1 * | 2/2022 | Smith | A63B 21/023 |

* cited by examiner

*Primary Examiner* — Gary D Urbiel Goldner
(74) *Attorney, Agent, or Firm* — Rosenberg, Klein & Lee

(57) ABSTRACT

A push-up exercise device with height adjustment includes two bases and a grab rail mounted to and located between the two bases. Each base is provided with a mounting hole at a center of the base and a positioning piece in the mounting hole. A plurality of mounting slots with different lengths are disposed inside a mounting rod of the grab rail, extending from an open end of the mounting rod and corresponding to the positioning piece. The positioning pieces are configured to be aligned with and mounted into different lengths of the mounting slots to adjust a height of the grab rail of the push-up exercise device and in order to train different muscle groups and further shape a body of a user and improve the fitness of the user.

9 Claims, 11 Drawing Sheets

PUSH-UP EXERCISE DEVICE WITH HEIGHT ADJUSTMENT

BACKGROUND OF THE INVENTION

Field of the Invention

The present invention relates to a push-up exercise device with height adjustment, especially to a push-up exercise device in which the height of a grab rail is able to be adjusted.

Description of Related Art

In the busy society nowadays, people find it easy to neglect exercise because of work. Thus some people now have fitness equipment at home to exercise at their leisure time. Most of the fitness equipment is heavy and bulky, taking up space, and unable to move easily. Thus small fitness equipment such as stepper machines, push-up bars, chest expander, etc. is more popular. These exercise devices are small in size and suitable for a limited space at home so that users can work out for fitness at all times.

As to the chest expander, it mainly includes springs with tension and grips disposed on two sides of the springs. The user can do training with the chest expander to exercise different parts of the body such as pectorals, biceps, etc. Beside the workout you can get, the chest expander also helps you stay in shape. The push-up exercise device which works in training upper body muscles is composed of a hand grip and two bases each of which includes a horizontal tube and a vertical tube connected to a middle portion of the horizontal tube. The hand grip has a grip portion and two insertion portions formed by two ends of the hand grip bent downward. Each of the insertion portions is axially inserted into the vertical tube of the base.

When users do push-ups with the push-up exercise device, their hands hold the grip portions. Without being contact with the ground, the users' hands will not get dirty or slip on the ground. However, the push-up exercise device has the following issues. The position of the grip portion of the push-up exercise device with respect to the ground/space is unable to be modified according to individual's preference or training intensities. Thus only specific groups of muscles are trained and users may be bored. The purpose of shaping the body is also unable to be achieved.

Thus there is room for improvement and there is a need to provide a push-up exercise device with height adjustment which is more convenient to use.

SUMMARY OF THE INVENTION

Therefore it is a primary object of the present invention to provide a push-up exercise device with height adjustment in which the height of a grab rail is able to be adjusted so that the push-up exercise device is more convenient to use.

In order to achieve the above object, a push-up exercise device with height adjustment according to the present invention includes two bases and a grab rail mounted to and connected between the two bases. A mounting hole is formed at a center of the base and a positioning piece is disposed in the mounting hole while a plurality of mounting slots with different lengths are disposed inside a mounting rod on each of two ends of the grab rail and corresponding to the positioning piece. Thereby the height of the grab rail of the push-up exercise device can be adjusted by the positioning pieces being aligned with and mounted into the mounting slots with different lengths to train different muscle groups, further shape the body, and improve the fitness.

Preferably, the base is polygonal.

Preferably, a mark is labeled on a surface of the grab rail while a plurality of different height level indicators are labeled on two opposite corners of the polygonal base. The height of the grab rail can be adjusted to the required level by the mark selectively aligned with one of the height level indicators.

Preferably, a surface of the grab rail is provided with a protective sleeve for users to hold.

Preferably, an anti-slip washer is arranged under the base. Thus the push-up exercise device with height adjustment will not move freely for safety of the user while in use.

Preferably, the grab rail can be a straight rod or an inclined rod.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content and functions of the present invention more completely and clearly, please refer to the following embodiments with detailed descriptions together with the related figures and numbers therein.

Figure 1:
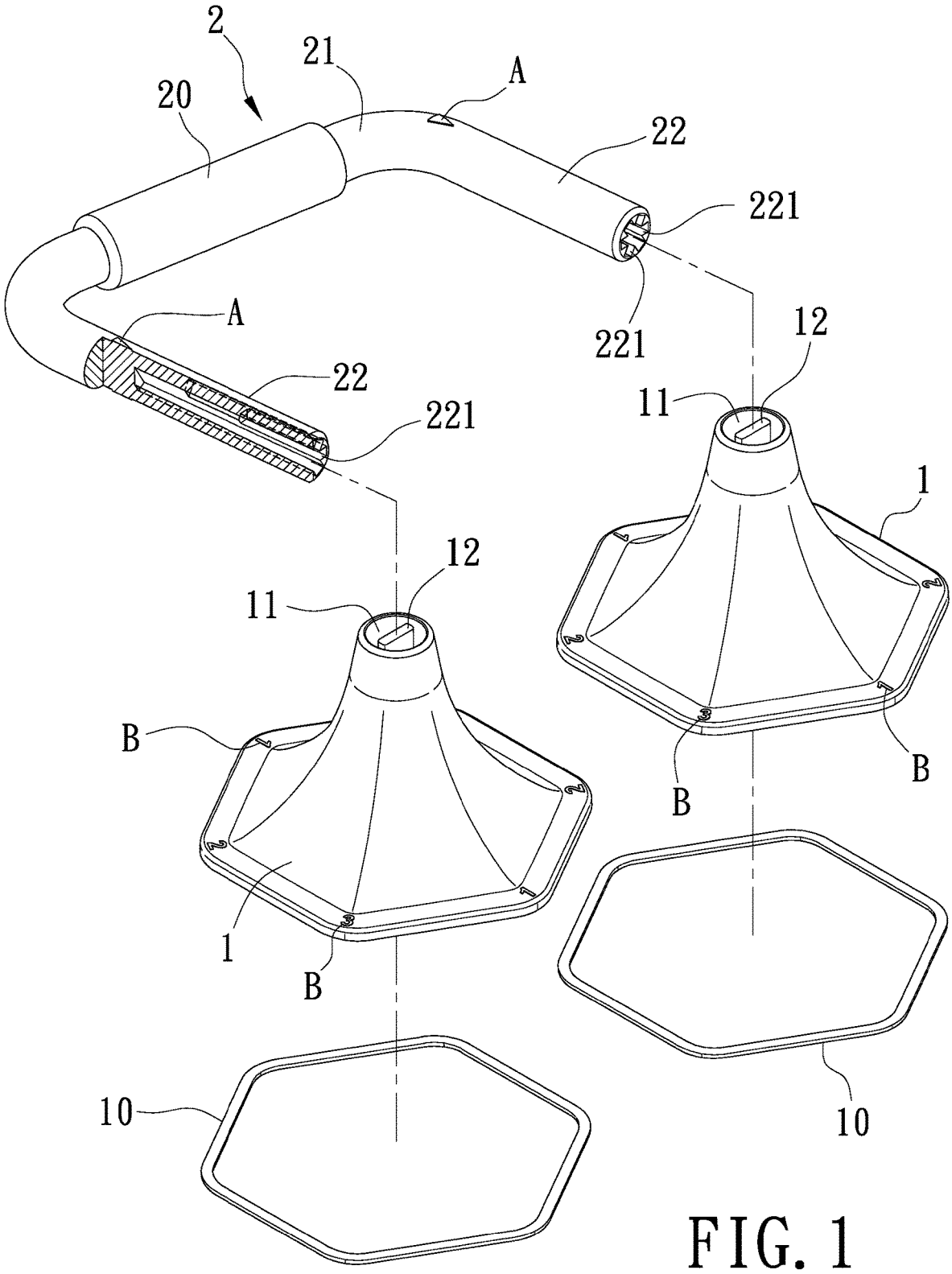
FIG. 1 is an explosive view of an embodiment according to the present invention.
Figure 2:
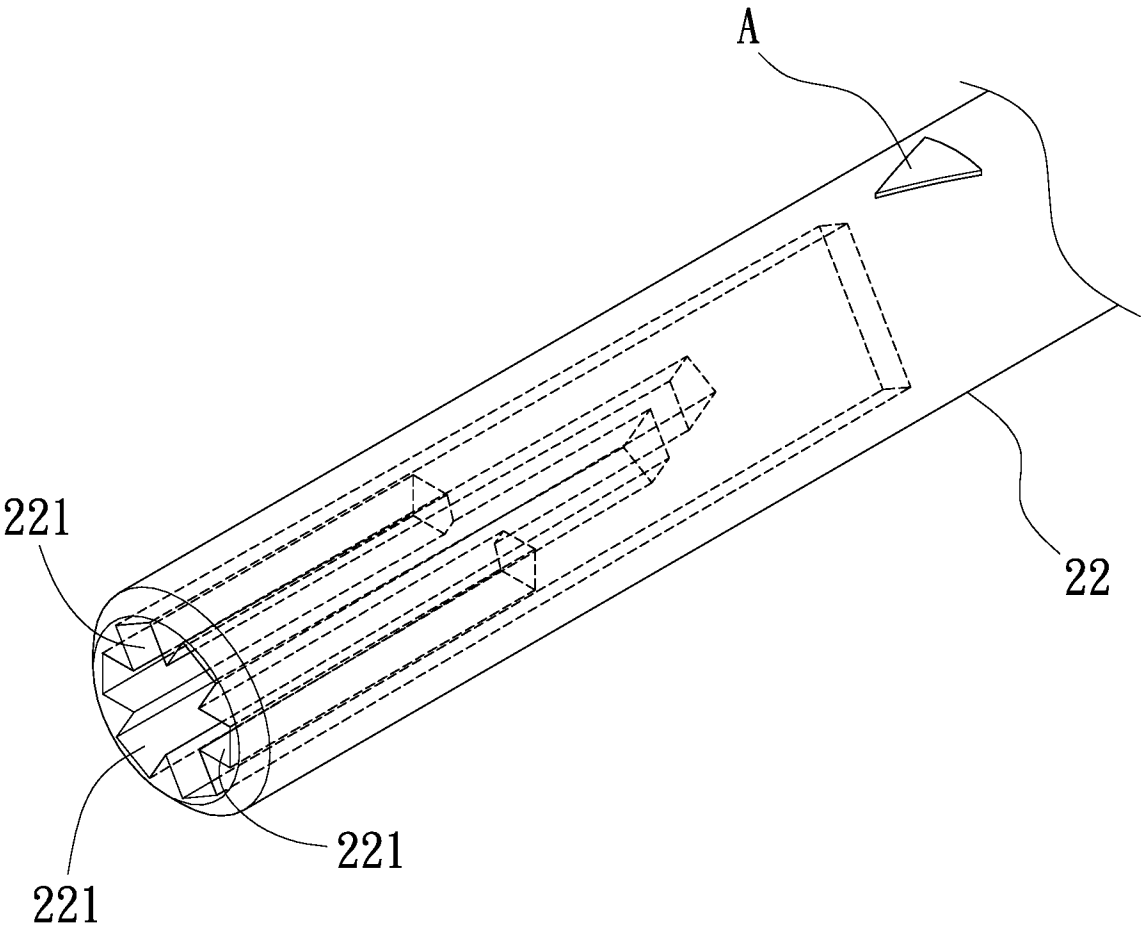
FIG. 2 is a partial perspective view of an embodiment according to the present invention.
Figure 3:
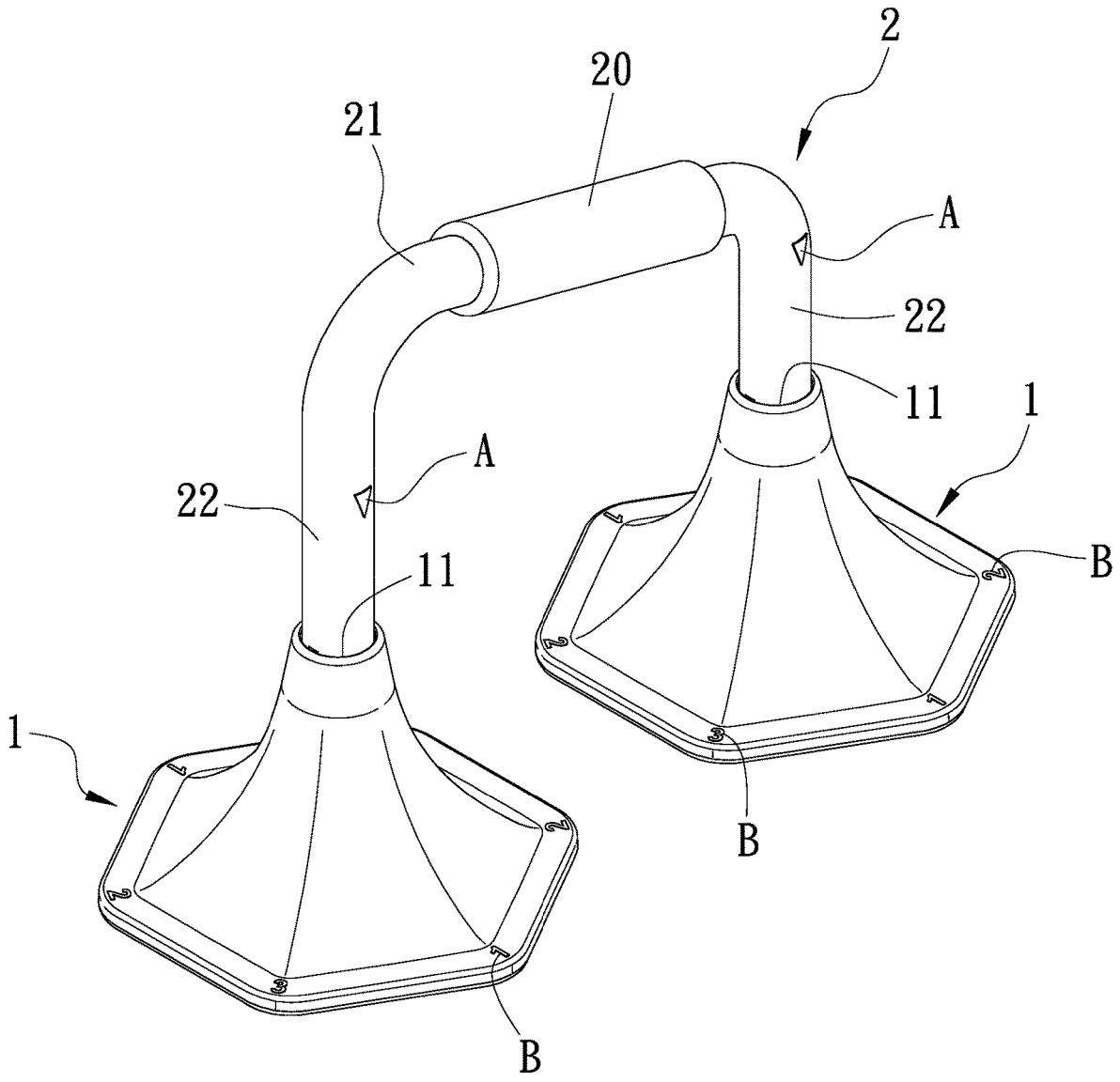
FIG. 3 is a perspective view of an embodiment according to the present invention.

Refer to FIG. 1, FIG. 2, and FIG. 3, a push-up exercise device with height adjustment according to the present invention includes two bases 1 and a grab rail 2.

Each of the bases 1 is provided with a mounting hole 11 at a center of the base 1 and a positioning piece 12 in the mounting hole 11.

The grab rail 2 consists of a holding portion 21 and two mounting rods 22 connected to two ends of the holding portion 21 correspondingly. A plurality of mounting slots 221 with different lengths are disposed inside the mounting rod 22, extending from an open end to an inner space of the mounting rod 22, and corresponding to the positioning piece 12. The mounting slot 221 and the positioning piece 12 are engaged with each other to make the two ends of the grab rail 2 locate at different levels/heights.

Refer to FIG. 4-9, users can adjust positions of the two ends of the grab rail 2 according to muscle groups they intend to train. During push-ups, muscles at the upper limbs, the lumbar and the abdomen are involved and worked. By changing positions of the two ends of the grab rail 2, muscle groups at the upper limbs, the lumbar and the abdomen such as pectoralis major muscle, triceps brachii muscle, etc. are targeted while anterior deltoid muscle, serratus anterior muscle, coracobrachialis muscle and rest parts of the body are also recruited in the performance of the exercise.

Figure 4:
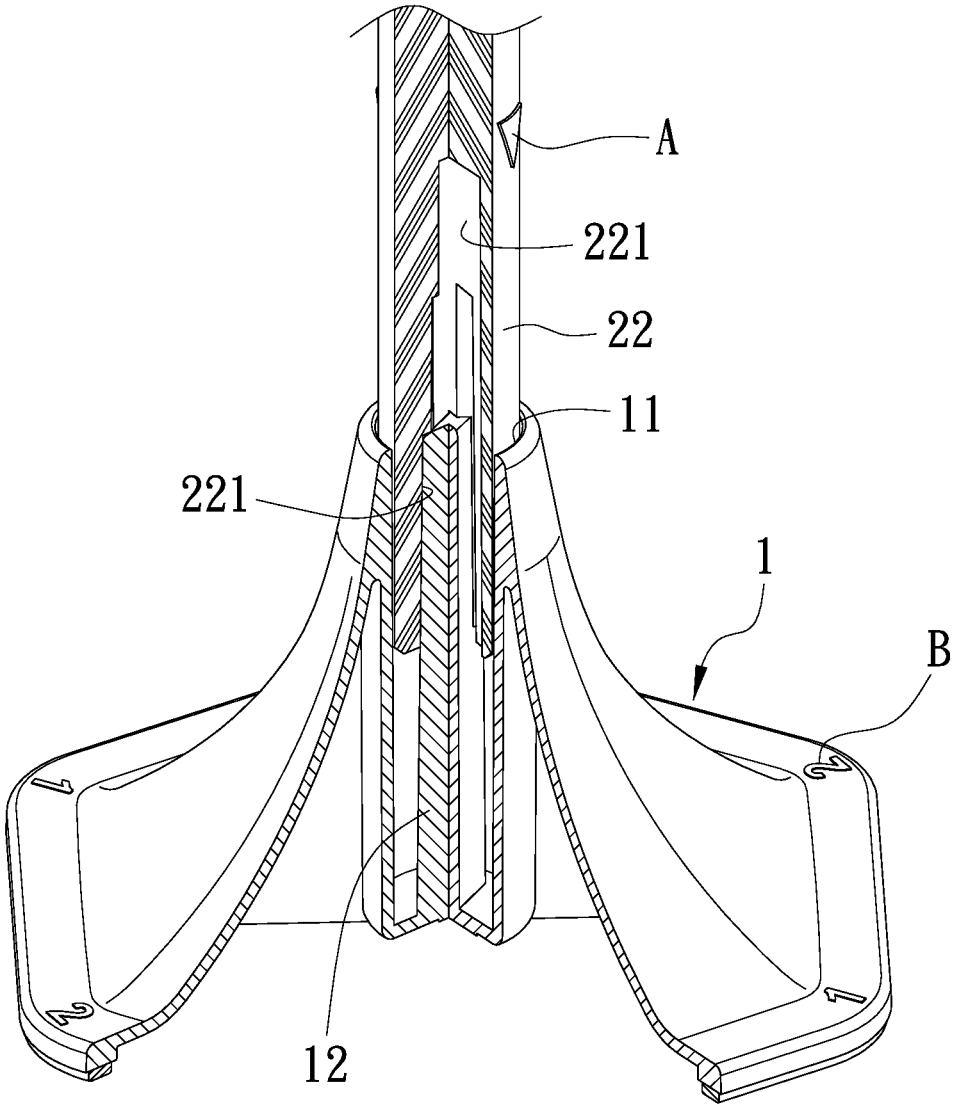
FIG. 4 is a partial perspective sectional view of an embodiment according to the present invention.
Figure 5:
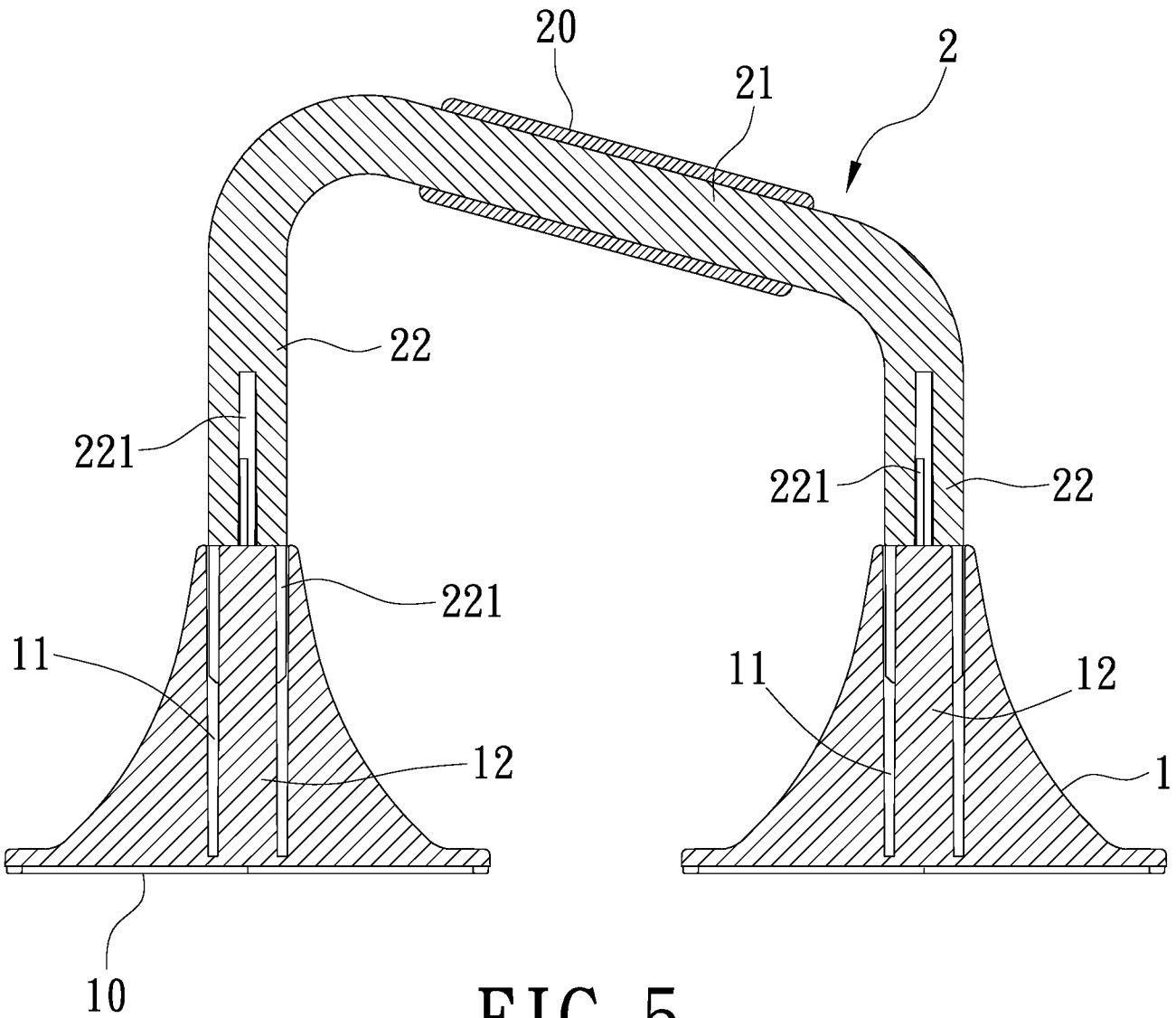
FIG. 5 is a sectional view of an embodiment in which two ends of a grab rail are at different levels according to the present invention.
Figure 6:
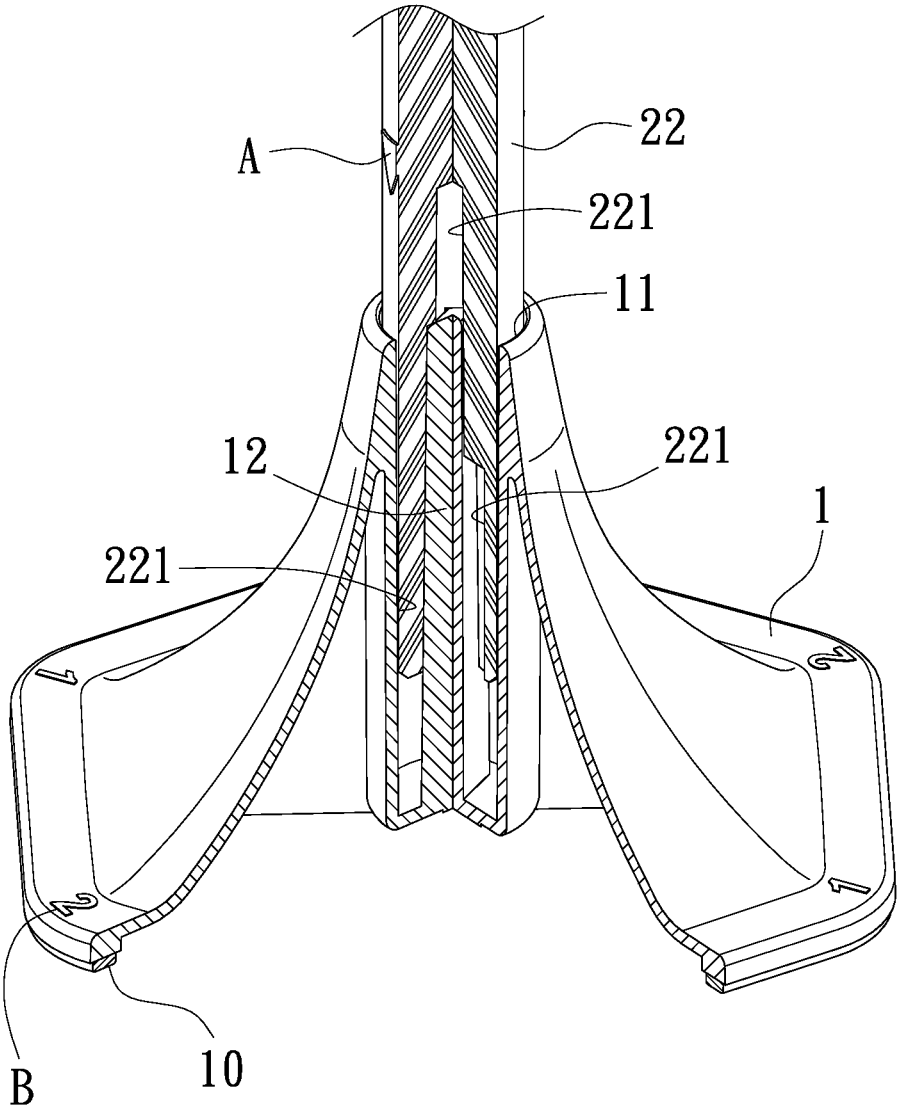
FIG. 6 is another partial perspective sectional view of an embodiment according to the present invention.
Figure 7:
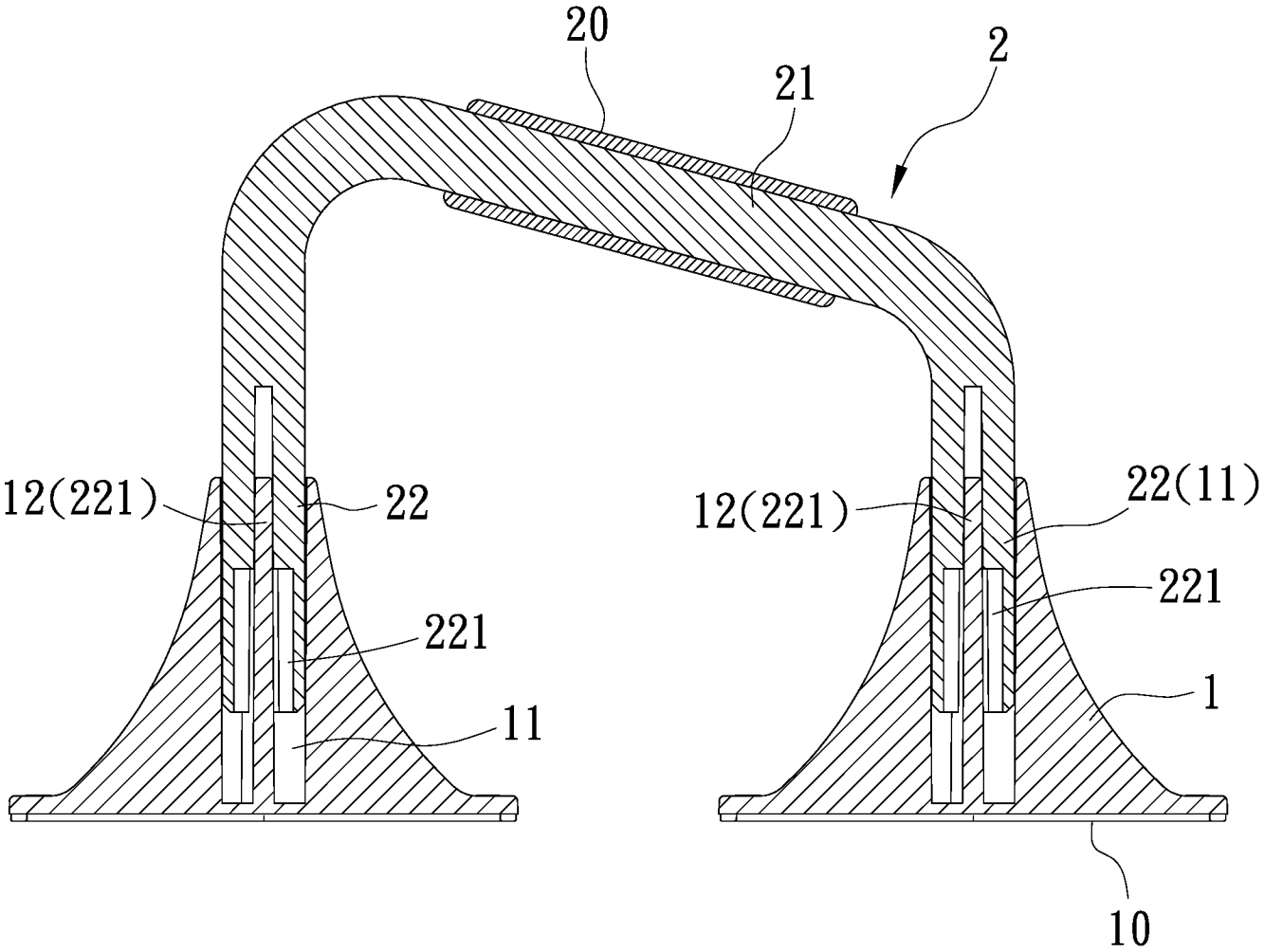
FIG. 7 is another sectional view of an embodiment in which two ends of a grab rail are at different levels according to the present invention.
Figure 8:
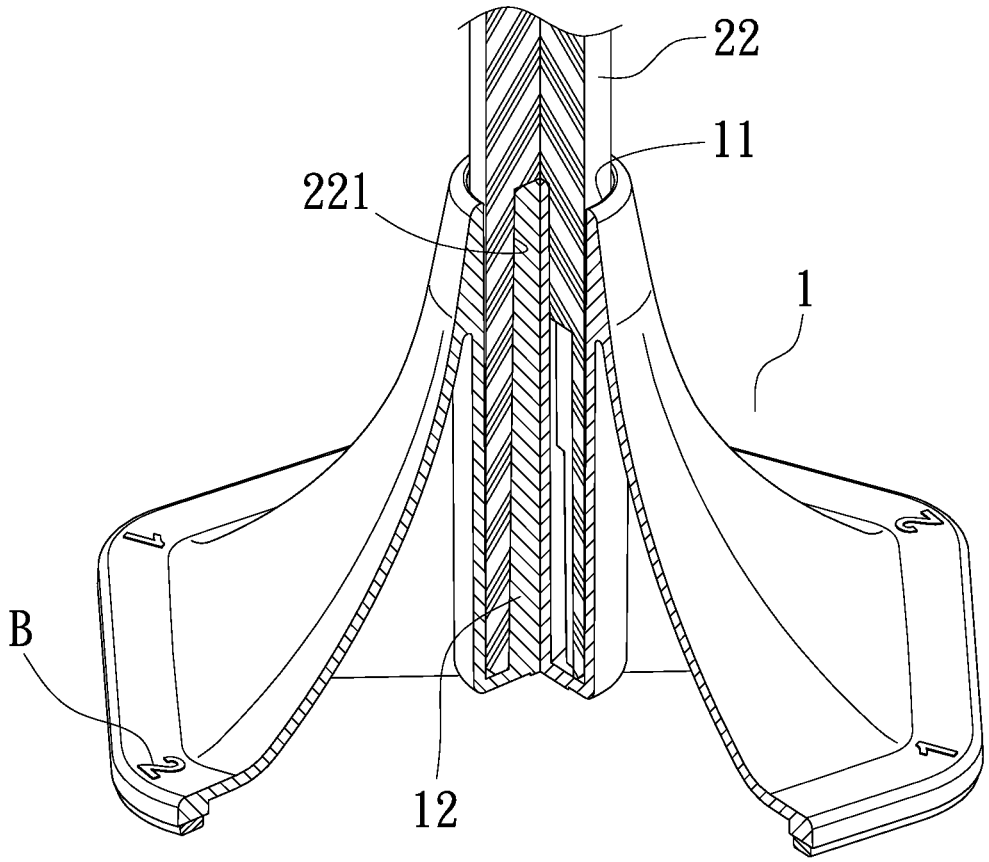
FIG. 8 is a further partial perspective sectional view of an embodiment according to the present invention.
Figure 9:
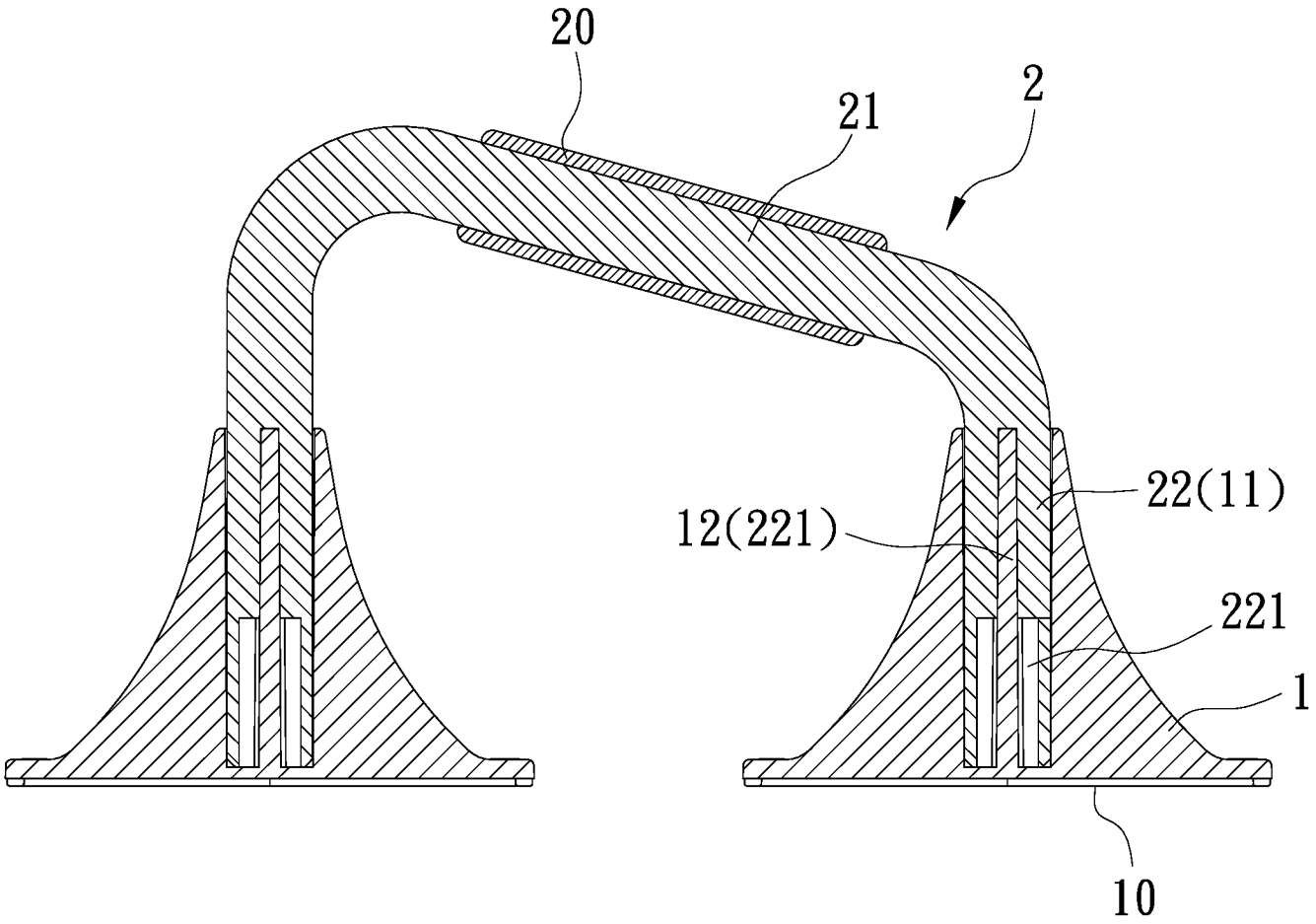
FIG. 9 is a further sectional view of an embodiment in which two ends of a grab rail are at different levels according to the present invention.

For convenient height adjustment, a mark A which is able to be an arrow, an indicator line, etc. is labeled on a surface of the grab rail 2 while the bases 1 is polygonal such as rectangular, hexagonal, octagonal, etc. The base 1 shown in figures is hexagonal. There are different height level indicators B labeled on two opposite corners of the base 1. In this embodiment, there are three kinds of height levels 1, 2, and 3 able to be selected. Thus the user can adjust the height required in a real-time manner easily by the mark A selectively aligned with one of the height level indicators B. As shown in FIG. 4 and FIG. 5, the mark A on the grab rail 2 is aligned with the position of the height level 1 on the polygonal base 1 and the positioning piece 12 of the polygonal base 1 is mounted into one of the mounting slots 221 corresponding to the height level 1. This mounting slot 221 is a shallow slot so that the grab rail 2 is assembled and located at the high level. Refer to FIG. 6 and FIG. 7, the mark A on the grab rail 2 is aligned with the position of the height level 2 on the polygonal base 1 and the positioning piece 12 of the polygonal base 1 is mounted into one of the mounting slots 221 corresponding to the height level 2. This mounting slot 221 is an intermediate slot so that the grab rail 2 is assembled and located at the intermediate level. As shown in FIG. 8 and FIG. 9, the mark A on the grab rail 2 is aligned with the position of the height level 3 on the polygonal base 1 and the positioning piece 12 of the polygonal base 1 is mounted into one of the mounting slots 221 corresponding to the height level 3. This mounting slot 221 is a deep slot so that the grab rail 2 is assembled and located at the low level.

Figure 10:
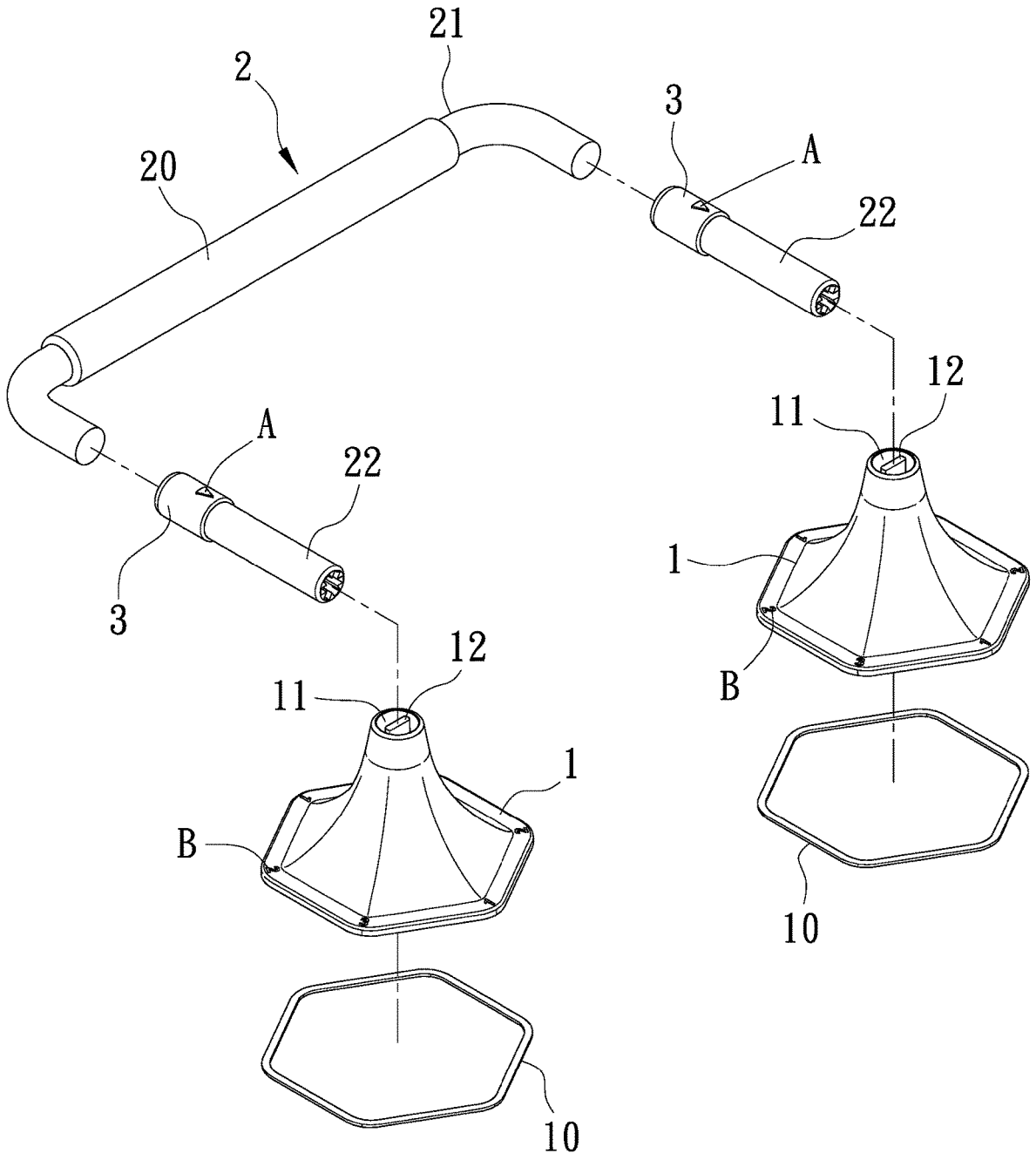
FIG. 10 is an explosive view of another embodiment according to the present invention.
Figure 11:
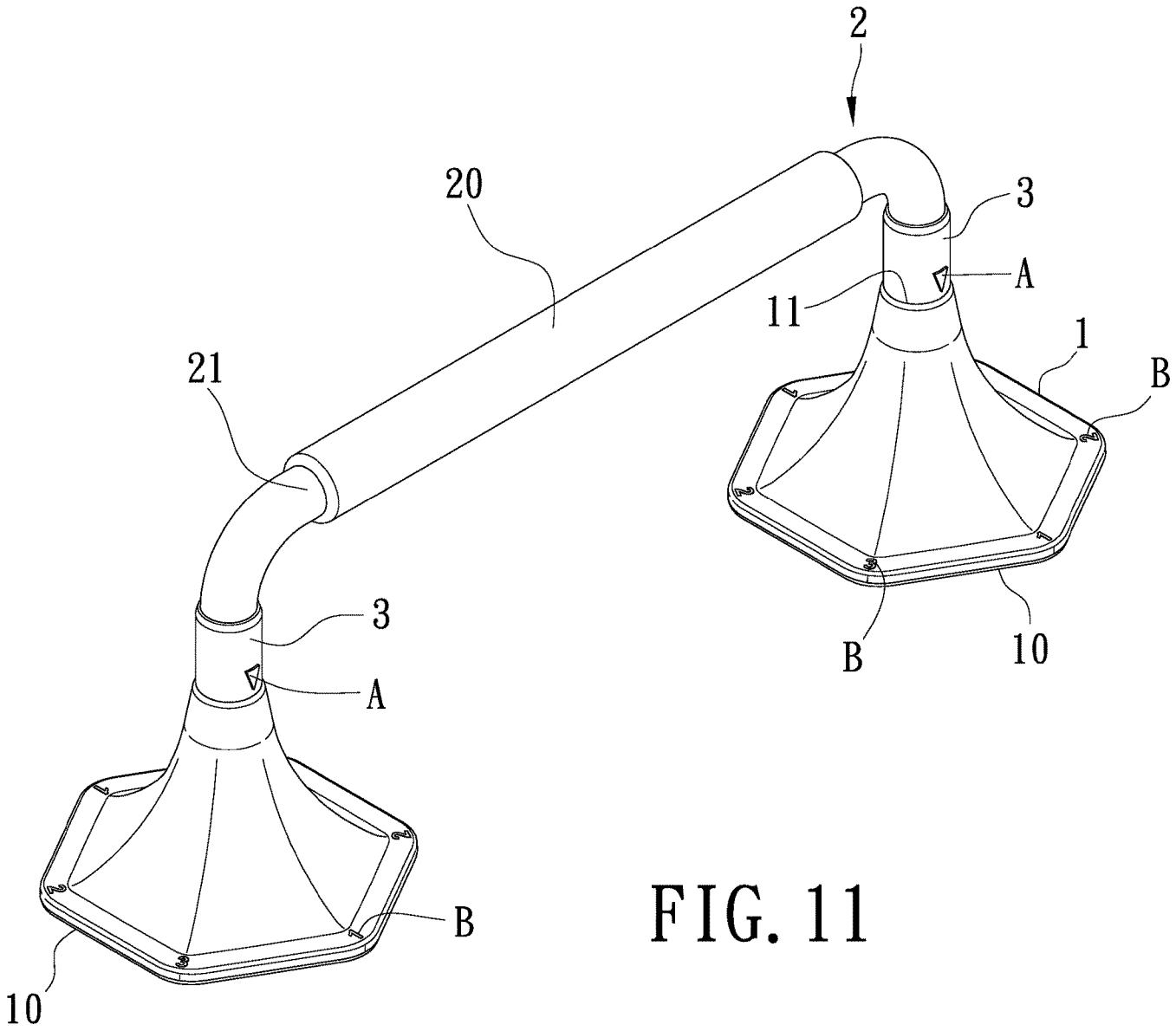
FIG. 11 is a perspective view of the embodiment in FIG. 10 according to the present invention.

The two ends of the holding portion 21 of the grab rail 2 are extended to form the two mounting rods 22 correspondingly and the mounting rods 22 are integrated with the holding portion 21 to form one part, as shown in FIG. 1. Refer to FIG. 10 and FIG. 11, another embodiment is revealed. In this embodiment, the holding portion 21 and the mounting rods 22 are independent parts. The push-up exercise device with height adjustment further includes two tubular members 3. One end of the tubular member 3 is connected to the holding portion 21 while the other end thereof is mounted with and connected to the mounting rod 22. A surface of the tubular member 3 can be provided with the mark A.

Moreover, for safety of the user, an anti-slip washer 10 is arranged under the base 1 so that the push-up exercise device with height adjustment will not move freely. The grab rail 2 allowing users to hold can be a straight rod or an inclined rod. A surface of the holding portion 21 is provided with a protective sleeve 20 for users to hold.

In summary, the present invention has the following advantages compared with the structure of the exercise device available now.

1. By the positioning pieces being aligned with and mounted into the mounting slots with different lengths inside the mounting rod, the height of the grab rail of the push-up exercise device can be adjusted for training different muscle groups and further shaping the body and improving the fitness.

2. By the mounting of the positioning piece into the mounting slots, users can adjust the height of the grab rail easily and conveniently. The push-up exercise device with height adjustment is more convenient to use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A push-up exercise device with height adjustment, comprising:

two bases each of which is provided with a mounting hole at a center thereof and a positioning piece disposed in the mounting hole; and a grab rail which includes a holding portion and two mounting rods respectively connected to two ends of the holding portion;

wherein a plurality of mounting slots with different lengths are disposed inside each mounting rod, extending from an open end to an inner space of each mounting rod, and corresponding to the positioning piece; and wherein the plurality of mounting slots are each selectively engageable with the positioning piece to locate the open ends of the grab rail at different heights.

2. The push-up exercise device as claimed in claim 1, wherein the mounting rods are integrally extended from the two ends of the holding portion of the grab rail, respectively.

3. The push-up exercise device as claimed in claim 1, wherein the push-up exercise device further includes two tubular members each of which has one end thereof respectively connected to one of the two ends of the holding portion of the grab rail, and another end thereof is respectively mounted with and connected to one of the two mounting rods for connecting the two mounting rods to the holding portion.

4. The push-up exercise device as claimed in claim 1, wherein each base is a polygonal base.

5. The push-up exercise device as claimed in claim 4, wherein a mark is labeled on a surface of the grab rail and a plurality sets of different height level indicators corresponding to the mark are labeled on each base.

6. The push-up exercise device as claimed in claim 3, wherein a mark is arranged on a surface of each tubular member.

7. The push-up exercise device as claimed in claim 1, wherein a surface of the grab rail is provided with a protective sleeve configured to be held.

8. The push-up exercise device as claimed in claim 1, wherein an anti-slip washer is arranged under each base.

9. The push-up exercise device as claimed in claim 1, wherein the grab rail is coupled to the two bases and the two bases are positioned onto a horizontal surface, a central region of the holding portion is inclined from or substantially parallel to the horizontal surface.

* * * * *